United States Patent [19]

Hey et al.

[11] Patent Number: 4,721,286

[45] Date of Patent: Jan. 26, 1988

[54] SPLIT BLOCK FOR EXTENDED TRAVEL

[75] Inventors: John E. Hey, Houston, Tex.; H. Patrick Ragland, Thibodaux, La.

[73] Assignees: AMCA International Corporation, Hanover, N.H.; McDermott Incorporated, New Orleans, La.

[21] Appl. No.: 758,355

[22] Filed: Jul. 24, 1985

[51] Int. Cl.[4] ..... B66D 3/08

[52] U.S. Cl. ..... 254/399; 254/401

[58] Field of Search ..... 254/393, 394, 398, 399, 254/400, 404, 281, 285, 326, 401

[56] References Cited

U.S. PATENT DOCUMENTS

| | | | |
|---|---|---|---|
| 484,038 | 10/1892 | Morgan | 254/399 |
| 1,043,928 | 11/1912 | Harris | 254/399 |
| 1,436,608 | 11/1922 | Rodier | 254/399 |
| 1,734,047 | 11/1929 | Pippen et al. | 254/398 |
| 2,068,638 | 1/1937 | Nichols | 254/399 |
| 2,546,683 | 3/1951 | Young | 254/399 |
| 2,734,718 | 2/1956 | Minor | 254/399 |
| 2,973,942 | 3/1961 | Schaper | 254/399 |
| 3,794,185 | 2/1974 | Kroll et al. | 254/399 |
| 3,936,034 | 2/1976 | Larralde | 254/399 |
| 4,084,794 | 3/1978 | Wallace | 254/399 |

FOREIGN PATENT DOCUMENTS

| | | | |
|---|---|---|---|
| 346 | 1/1979 | Japan | 254/399 |
| 452872 | 9/1936 | United Kingdom . | |

*Primary Examiner*—Stuart S. Levy

*Assistant Examiner*—Joseph J. Hail, III

*Attorney, Agent, or Firm*—Richards, Harris, Medlock & Andrews

[57] ABSTRACT

A crane block (FIG. 2) is provided for traveling along a central main fall symmetry line (78) defining vertical travel during movement of a hoist within a barge mounted crane. The crown block (50) is mounted to a crane boom (12) and includes a first row of relatively large diameter sheaves (54) in tandem with a second row of relatively small diameter sheaves (58). A movable block (76) is provided between the traveling block (74) and the crown block (50) and includes a third row of relatively small diameter sheaves (60) which are reeved together with the second row of sheaves. A traveling block (74) is provided with a fourth row of relatively large diameter sheaves (56) which are reeved together with the first row of sheaves (54). Sheaves in either the second (58) or third (60) rows are horizontally canted with respect to the main fall symmetry line (78) for vertical travel of the rope which is reeved between the rows. The movable block section (76) may be connected with the traveling block (74) for lifting relatively heavy loads over relatively small vertical travel distances. Conversely, movable block (76) may be two-blocked beneath the crown block (50) to enable the traveling block (74) to obtain extended travel distances at increased speed for relatively lighter loads without the need to re-reeve the main block.

5 Claims, 10 Drawing Figures

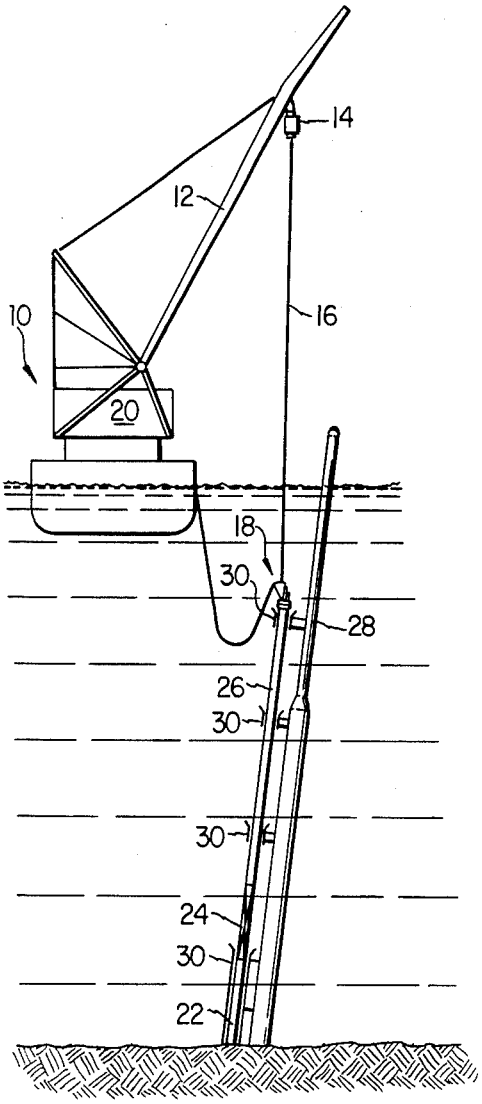
FIG. 1
FIG. 2
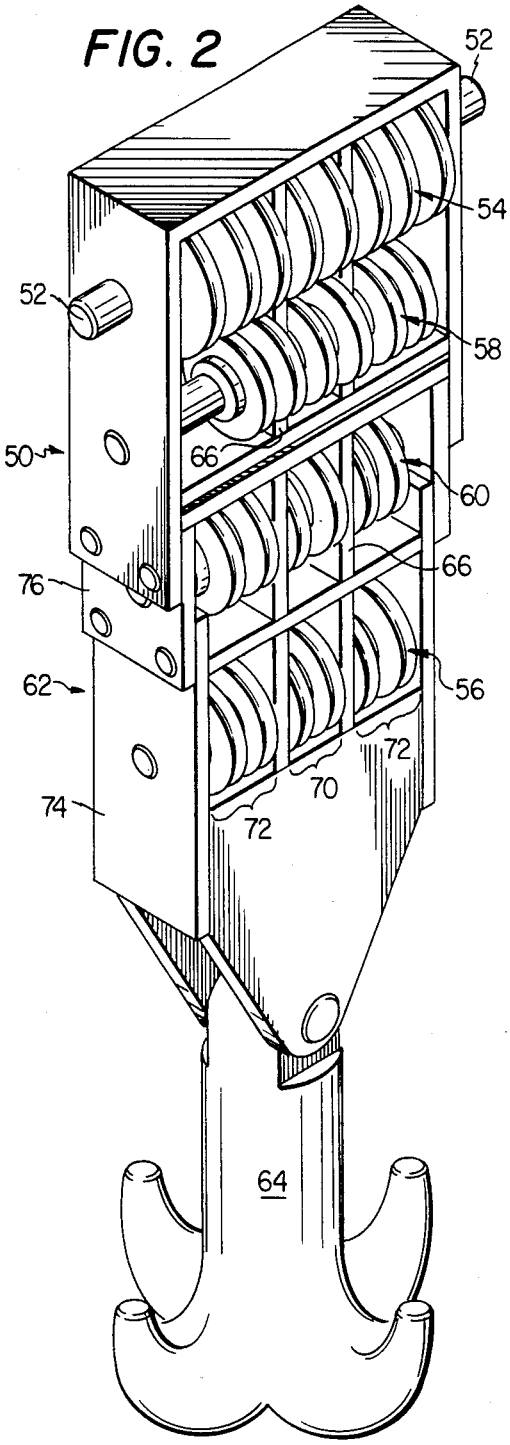

FIG. 7
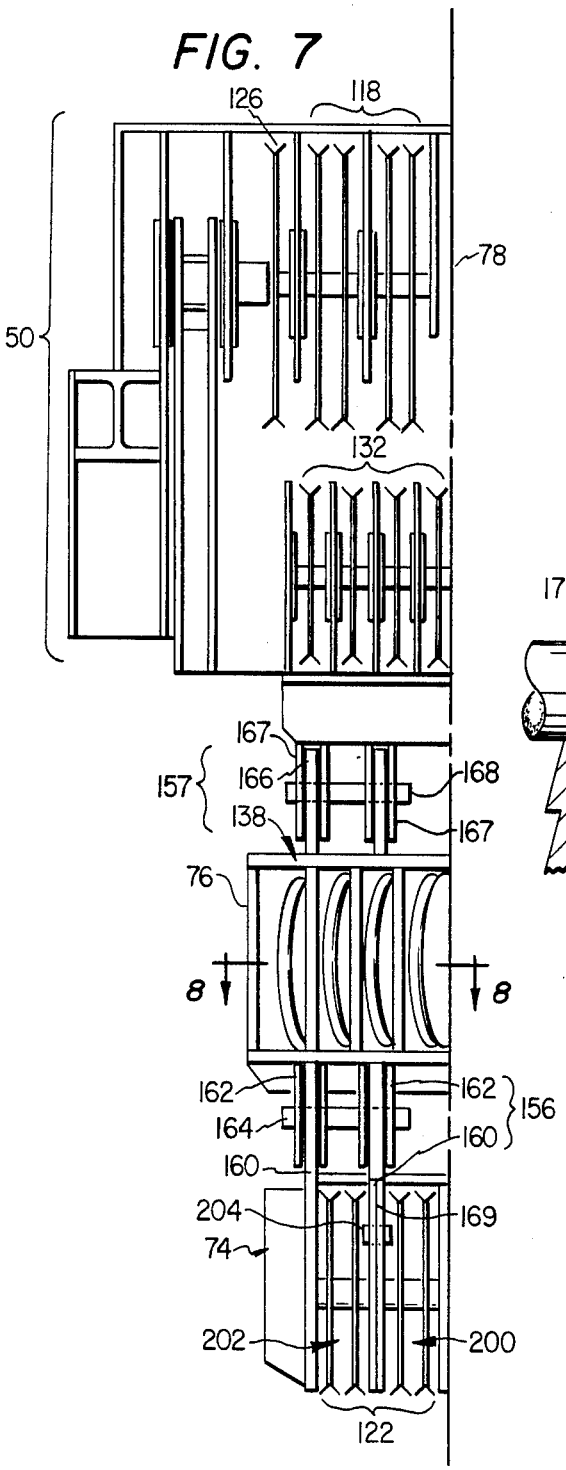
FIG. 8
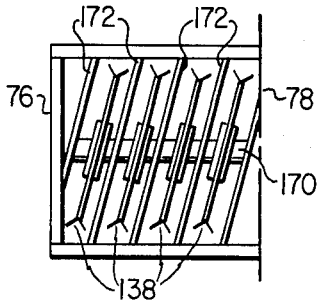
FIG. 9
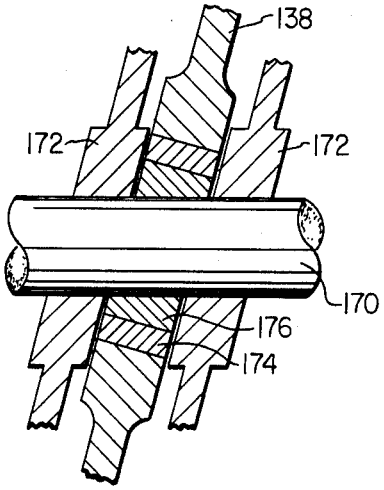
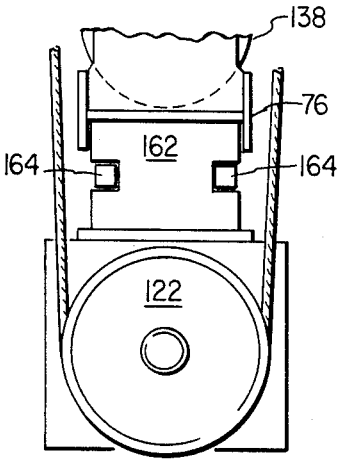
FIG. 10

SPLIT BLOCK FOR EXTENDED TRAVEL

TECHNICAL FIELD

This invention relates to blocks for use with cranes and, more particularly, to main blocks with anti-spin features for use over extended vertical travel distances, particularly at underwater locations.

BACKGROUND OF INVENTION

Cranes are frequently used in the offshore oil industry in the construction of offshore drilling and production platforms. Conventionally, cranes have been designed to lift loads above the surface of the sea and the vertical length of lift is between the boom point and the sea surface. Cranes conventionally use blocks mounted to a boom with the wire rope reeved through the blocks to determine the crane lifting capacity in conjunction with tackle design and wire rope safety factors.

Several blocks may be provided along a crane boom, conventionally referred to as the "main" block, "auxiliary" block, "whip" block, etc. The blocks are sized to match the load which might be lifted at the selected reach of the crane boom. Thus, an outboard block would have fewer sheaves, with concurrent decrease in crane capacity and increase in travel ratio relative to inboard blocks.

The production of oil from offshore locations has moved progressively to deeper locations. A need has arisen for cranes with a capability of lifting over extended distances, including submerged locations adjacent to the sea floor.

A first problem arises in accommodating the length of wire rope required for the extended vertical travel. The anticipated loads for the submerged operations might be handled by blocks other than the main block. However, these auxiliary blocks are generally connected with a single hoist drum which provides insufficient wire rope storage and does not provide a balanced hoist reeving capability. It will be appreciated that only limited space is available with the rotating crane machinery cab mounted on the flotation barge to accommodate an increase in hoist capabilities for these auxiliary blocks. Costs of modifying existing equipment can range from substantial to prohibitive.

Differential horizontal forces across a block give rise to a torque tending to twist the ropes connecting the load to be lifted with the boom. The amount of angular rotation is a function of the length of the lift and is not a particular problem for conventional lifts above the sea surface. However, for the extended lifts required to handle equipment adjacent the sea floor, a degree of rotation can arise which effectively prevents operation of the crane due to friction forces between the ropes which are rotated into binding contact.

Both static and dynamic forces can arise during the extended block travel. Sheaves rotate at different speeds within the block, fastest adjacent the hoist rope leadout and slowest adjacent the stationary end of the rope. Thus, a gradient of friction forces arise across the block. Other horizontal forces can arise across the block tending to rotate the block such as, for example, forces arising from the rope offlead in passing between two parallel sheaves. The rope design itself, i.e. right or left lay, can introduce angular torsional forces.

The main block generally has adequate rope hoist capacity stored in the crane house for the long lifts of interest. However, the conventional reeving configuration to obtain the heavy lift capability above the sea surface does not enable the stored rope to be used for extended travel without re-reeving the entire block assembly. Further, conventional main blocks have a plurality of sheaves which tend to increase the differential forces acting to rotate the rope assembly. Further, in particular applications, the undersea block must cooperate with guide assemblies which direct the operation occurring on the sea floor. Conventional main blocks are simply too large to pass through guide assembly dimensions which are useful in correcting the underseas operation.

Thus, a need has arisen for a main block with increased versatility. It would be desirable to minimize horizontal forces generated within the block tending to rotate the wire ropes. It would be desirable to enable the speed and travel of the main block to be increased without having to re-reeve the block. It would further be desirable to enable the main block to be used with conventional guide assemblies. Additionally, it would be desirable to utilize only the active sheaves needed for the particular load to be lifted in order to minimize wear on the rope and the sheaves and to further minimize the required downhaul weight.

The disadvantages of the prior art are overcome by the present invention, however, and an improved apparatus is provided for configuring a main boom to accommodate a variety of load and travel conditions without the need to re-reeve the main block.

SUMMARY OF INVENTION

A crane block is provided which defines a central main fall symmetry line for vertical rope travel when the block is moved by a wire rope hoist. A crown block is mounted to a crane boom and includes a first row of relatively large diameter sheaves in tandem with a second row of relatively small diameter sheaves. A movable block is provided with a third row of relatively small diameter sheaves which are reeved together with the second row of sheaves in the crown block. A traveling block for connecting to a load is provided beneath the movable block with a fourth row of relatively large diameter sheaves which are reeved with the first row of sheaves in the crown block. One of the second or third rows of sheaves is horizontally canted with respect to the main fall symmetry line for vertical rope travel between the second and fourth rows of sheaves.

In a preferred embodiment, connecting means are provided for removably securing the movable block with the traveling block for lifting relative heavy loads over relatively small vertical travel to the sea surface. Further connecting means are provided for removably securing the movable block in two-blocked configuration beneath the crown block for lifting relatively lighter loads over relatively extended vertical travel beneath the sea surface.

A method is provided for configuring a rope on a main block having first and second portions symmetrical about a main fall symmetry line for minimizing forces tending to rotate the block during extended travel operation. The first portion of the block, defined by the main fall symmetry line, is first reeved by reeving together a row of relatively large diameter sheaves in a crown block and a row of relatively large diameter sheaves in a traveling block with the reeve moving in a first direction relative to the main fall symmetry line. The reeving is then continued in a second direction relatively opposite the first direction and between a row of relatively small diameter sheaves in the crown block and a row of relatively small diameter sheaves in a movable block. The sheaves in the movable block are canted about the main fall symmetry line to obtain substantially vertical reeving with no offlead angle between the rows of relative small diameter sheaves. The rope exits the block from the small diameter sheaves and passes to an equalizer sheave having an axis of rotation in the plane of the main fall symmetry line. The second portion of the block is then reeved in mirror image of the reeving of the first portion of the block.

These and other aspects of the present invention will become apparent in the following Detailed Description, wherein reference is made to the FIGURES in the accompanying Drawings.

IN THE DRAWINGS

FIG. 1 is a schematic illustration of an application of the crane main block according to one embodiment of the present invention.

FIG. 2 is an isometric illustration of one embodiment of the crane main block.

FIG. 7 is a front view in partial cut-away of an embodiment of the sheave configuration of FIG. 5.

FIG. 8 is a top view of the canted sheaves of FIG. 5.

FIG. 9 is a cross-section of a canted sheave axle and bearing mounting.

FIG. 10 is a side view of a connecton between sheave rows.

DETAILED DESCRIPTION

Figure 3:
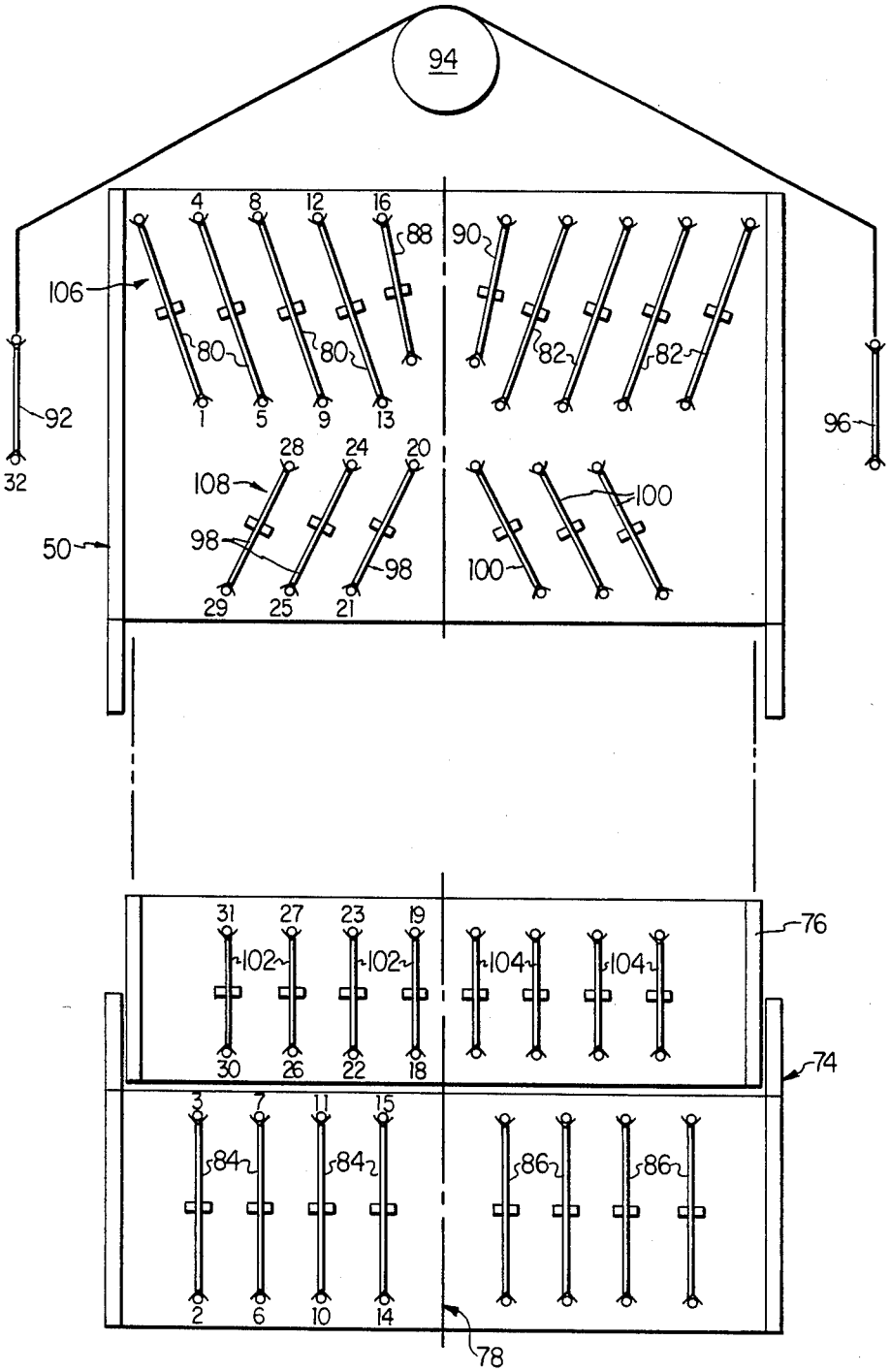
FIG. 3 is a schematic showing one balanced sheave configuration according to the present invention.

Referring first to FIG. 1, there is shown a schematic illustration of a crane main block 14 having an extended travel capability according to one embodiment of the present invention. Floating crane 10 is provided with boom 12 atop machinery cab 20. Machinery cab 20 contains the drawworks for hoisting the loads to be lifted, with concomitant drive motors and operating drums for the ropes. Crown block 14 is shown attached to boom 12 at a location conventional for main blocks. Other blocks may be attached to boom 12 outboard of main block 14 to handle lifts with lighter loads over relatively restricted elevations.

In one application, floating crane 10 is used in support of pile driving operations on the sea floor. Thus, pile 22 is used to penetrate the sea floor to a predetermined depth and pile driver 24 is used to impact the pile 22 into the sea floor. As shown in FIG. 1, pile 22 and pile driver 24 are guided and supported by guides 30 held by guide support 28. An extension 26 may be provided above pile hammer 24 to reduce the overall lift elevation.

Traveling block 18 is within extension 30, or in a sleeve above pile hammer 24, and is sized to be enclosed. According to the present invention, traveling block 18 may be lowered beneath boom 12 as necessary to support the pile driving operations, passing through guides 30. As hereinafter described, the block configuration enables extended lifts to be made without the torsional forces tending to cause wire ropes 16 to rotate into disabling engagement. The extended travel is made available using the length of wire rope stored on the main block hoist in machinery cab 20, while minimizing the wear on the rope and on the sheaves within crown block 14 and traveling block 18.

FIG. 2 is an isometric illustration of a crane main block according to one embodiment of the present invention. Tandem crown block 50 is provided with mounting trunnion 52 for fixing crown block 50 to a crane boom. A row of first large sheaves 54 and a row of first small sheaves 58 are provided in tandem within crown block 50. Beneath crown block 50 is traveling block section 74 with hook 64 secured thereto. Between crown block 50 and traveling section 74 is located movable block section 76 with a row of second small sheaves 60. Traveling block section 74 and movable block section 76 form split traveling block 62.

As shown in FIG. 2, movable section 76 may be "two-blocked" adjacent crown block 50 with first small sheave row 58 adjacent second small sheave row 60. The two-blocked configuration is obtained by providing canted sheaves in either sheave row 58 or sheave row 60, as hereinafter explained. Movable block section 76 may be fixed to either crown block 50 or to traveling block section 74 to obtain improvements in lift elevation capability, speed of operation, and wear reduction, without the need to re-reeve any component of the main block. As further shown in FIG. 2, traveling block section 74 includes vertical members 66 separating second large sheave row 56 into a set of inner sheaves 70 and sets of outer sheaves 72 to further enhance the lift versatility of main crown block 14 (FIG. 1) according to the present invention.

Referring now to FIG. 3, there is shown a schematic drawing of a balanced sheave configuration according to the present invention. The sheave configuration shown in FIG. 3 provides for eliminating forces from rope offlead angles, for cancelling forces due to sheave rotation, and for cancelling forces due to rope lay, if desired. Tandem crown block 50 is provided with first large canted sheaves 80 canted at a first angle to main fall symmetry line 78. Second large canted sheaves 82 are provided at a second angle which mirrors the first angle of cant for sheaves 80.

Traveling block section 74 is provided beneath crown block 50 with a row of second large sheaves 84 and 86. First large sheaves 80 are reeved with second large sheaves 84 and first large sheaves 82 are reeved with sheaves 86. Transistion sheaves 88 and 90 are provided in crown block 50 as the wire rope reeves between the large sheaves 80, 82, 84, and 86 and the small sheaves 98, 100, 102, and 104.

Tandem crown block 50 further includes first small canted sheaves 98 and 100 with sheaves 98 mounted at an angle with main fall symmetry line 78 which mirrors the angle for mounting sheaves 100. It will be noted from FIG. 3 that sheaves 98 have the same relative orientation as sheaves 82, and sheaves 100 have the same relative orientation as sheaves 80. Individual large sheave axles 106 and small sheave axles 108 are shown for mounting the individual sheaves. In an alternate embodiment, groups of the canted sheaves could be mounted on angled axles to simplify manufacture. In yet another alternate embodiment, sheaves 84, 86, 102, 104 in traveling and movable blocks 74, 76 could be canted in lieu of the respective mating sheaves 80, 82, 98, 100 in crown block 50.

Figure 4:
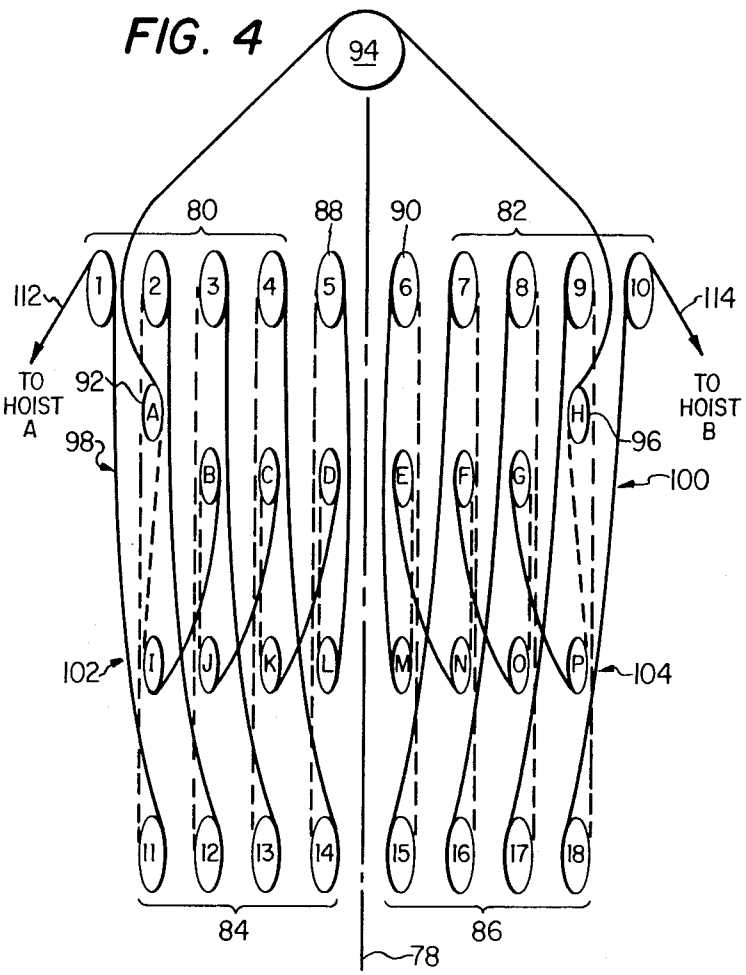
FIG. 4 is one reeving schematic for the sheave configuration of FIG. 3.

Thus, as further illustrated in FIG. 4, the wire rope 112 enters from the hoist and proceeds through the sheaves, as illustrated in FIG. 3 by sequential numbering (1)–(31). When the rope has reeved through the first arrangement of sheaves, first lead out sheave 92 accepts the wire rope from tandem crown block 50 directs the wire rope to equalizer sheave 94 and thence to second lead out sheave 96 for passage through the second half of sheaves. A second hoist is provided for rope 114 reeved through the second set of sheaves to balance the hoisting across blocks 50, 74 and 76. Ropes 112 and 114 join adjacent equalizer sheave 94 which has an axis of rotation in a plane including main fall line 78 which defines a plane of symmetry herein. Ideally, both hoists operate to take up the rope at the same rate where there is no relative movement of the rope across equalizer sheave 94 and main fall line 78. However, equalizer sheave 94 permits such relative movement where some inequalities may arise in the takeup rate from the two hoists or from differential rope stretch.

FIG. 4 more particularly depicts a rope reeving arrangement available with the sheave configuration shown in FIG. 3. Rope 112 leads from a first hoist and thence consecutively over first large sheaves 80 and second large sheaves 84, as depicted, to main fall line 78. Rope 112 then passes over transition sheave 85 and proceeds outwardly along second small canted sheaves 98 and second small sheaves 102 to leadout sheave 92 and thence to equalizer sheave 94.

Likewise, rope 114 from the second hoist proceeds inboard between first large canted sheaves 82 and second large sheeves 86 to transition sheave 90. Rope 114 thence transitions to reeve between first small canted sheaves 100 and second small sheaves 104 in an outboard direction from fall symmetry line 78 to leadout sheave 96. Rope 114 leads out to transition sheave 90 and meets with rope 112.

Referring now to FIGS. 3 and 4, it will be seen that the forces tending to rotate the ropes interconnecting tandem crown block 50 and lower block sections 74 and 76 are eliminated and/or cancelled. First, sheaves 80, 82, 88, 90, 98, and 100 may be canted. When ropes 112, 114 are reeved between consecutive sheaves, the canted sheaves eliminate the offlead angle giving rise to forces on the sheave rims. The angle of cant for the sheave rows is selected to provide vertical rope sections connecting the respective sheave. For example, first large canted sheaves 80 are reeved with second large sheave 84. The rope thus proceeds vertically from (1) to (2), from (3) to (4), etc. (see FIG. 3). First small canted sheaves 98 are canted at an angle to reeve with second small sheaves 102; first large canted sheaves 82 are mounted to reeve with second large sheaves 86; and first small canted sheaves 100 are angled to reeve with second small sheaves 104.

It will also be noticed from FIGS. 3 and 4 that a reeved configuration is provided to obtain equal and opposite dynamic forces from differential sheave rotations. By providing mirrored arrangements about main fall symmetry line 78, any remaining forces are in equal and opposite directions to obtain no net horizontal forces tending to rotate the extended wire ropes.

One other force tending to rotate the extending wire ropes involves the lay of the wire rope. Wire ropes are typically formed by twisting single wire elements together until a rope of the desired size is formed. The twisting may be "right-handed" or "left-handed" (i.e. right lay or left lay). When an axial force is applied to a twisted wire rope, an "untwisting" force is generated by the twisted elements. For small travel lifts, this force does not produce significant rotation of the ropes, but the degree of rotation increases as the travel length extends. Thus, for some extended lengths, it may be necessary to compensate for the lay of the rope. In this instance, the sheave arrangement depicted in FIG. 3 can be used to provide one rope lay on one side of main fall symmetry line 78 and the opposite rope lay on the opposing side of main fall symmetry line 78. The opposite lay ropes may be connected along the equalizer path between first leadout sheave 92 and second leadout sheave 96 where only limited travel of the wire rope would be expected.

It will also be appreciated from FIG. 3 that movable block section 76 may be two-blocked directly beneath tandem crown block 50. Conventionally, offlead angles are maintained below a design maximum which, in many instances, may not exceed 5°. The offlead angle increases in conventional reeving as the distance between sheaves is decreased, producing a minimum allowable spacing between, for example, a crown block and a traveling block. In conventional blocks, this minimum distance may be in the order of 30–60 feet and imposes some restrictions on use of the crane lifting capabilities.

The sheave configuration shown in FIG. 3 permits the offlead angle to be eliminated such that the sheaves may be two-blocked in adjacent configuration without regard to a minimum spacing. This two-blocked capability provides a compact storage configuration for securing the blocks within the boom or for simply permitting the blocks to hang loose while auxiliary tackle is being operated.

Figure 6:
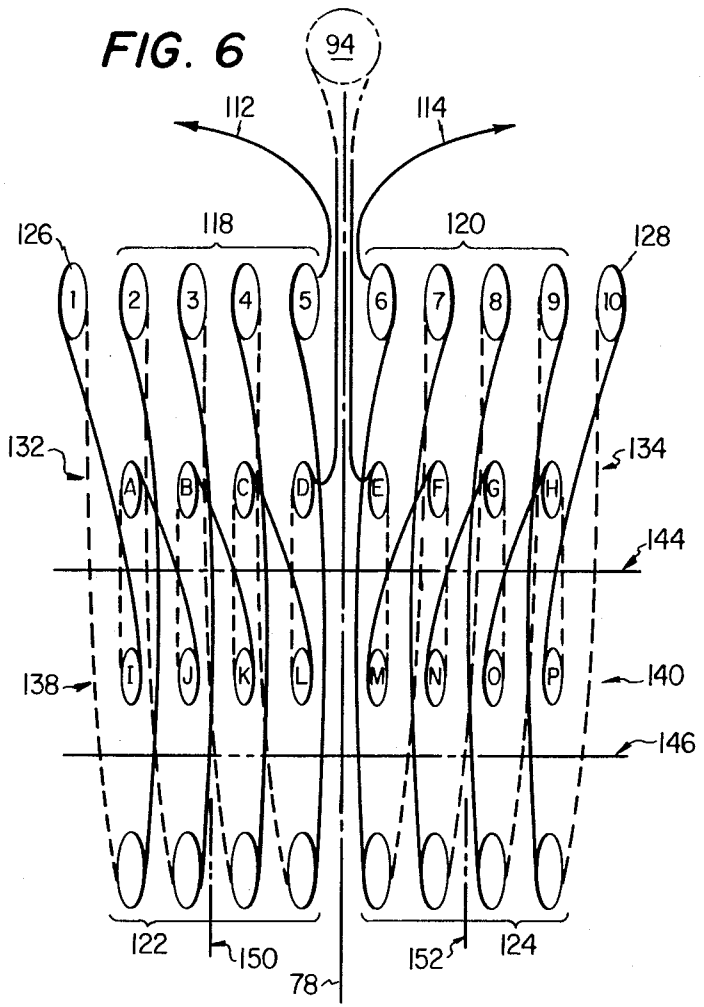
FIG. 6 is one reeving schematic for the sheave configuration of FIG. 5.
Figure 5:
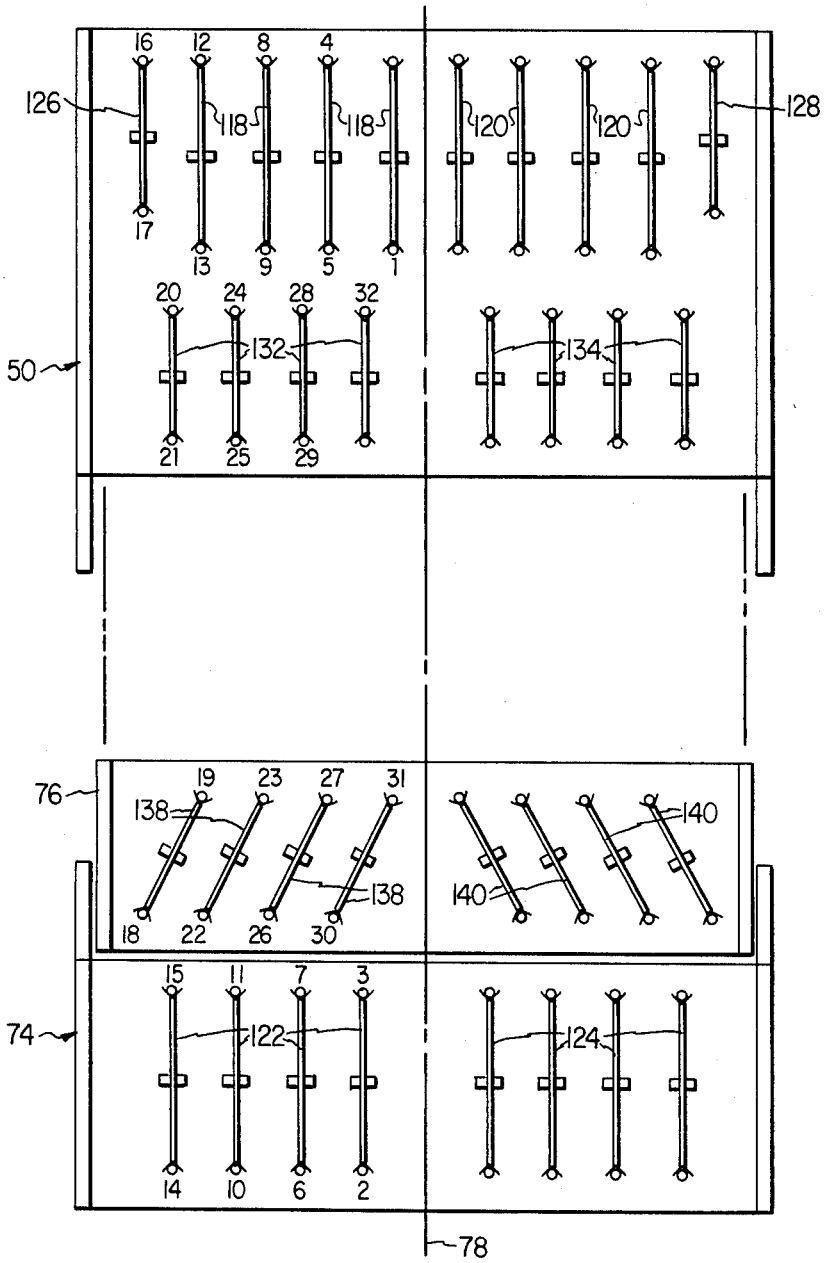
FIG. 5 is a schematic showing a second balanced sheave configuration.

Referring now to FIGS. 5 and 6, there is depicted an alternate balanced sheave configuration and the associated reeving schematic. Tandem crown block 50 includes first large sheaves 118, 120 and first small sheaves 132, 134 with transition sheaves 126 and 128. Traveling block section 74 includes second large sheaves 122, 124. Movable section 76 includes first small canted sheaves 138, 140. Canted sheaves 138 and canted sheaves 140 are in mirrored relationship about main fall symmetry line 78. The arrangement depicted in FIG. 5 provides a balanced reeving arrangement with the rope reeve beginning at (1) adjacent main fall line 78, with the rope hoist connection and equalizer offlead adjacent main fall line 78.

FIG. 6 more particularly depicts the reeving arrangement where rope 112 attached to a first hoist is reeved progressively outboard of main fall symmetry line 78 on first and second large sheaves 118, 122, through transition sheave 126 and inboard along small sheaves 132, 138. Rope 112 exits the block adjacent main fall line 78 for passage to equalizer sheave 94.

Likewise, rope 114 enters from the second hoist adjacent main fall symmetry line 78 and reeves outboard between large sheaves 120, 124, through transition sheave 128 and inboard between small sheave rows 134, 140. Again, rope 114 exits adjacent main fall symmetry line 78 for passage to equalizer sheave 94. Ropes 112 and 114 may form a continuous rope where a single lay can be tolerated. If opposite handed rope lays are desired, the lays may be joined adjacent equalizer sheave 94, as hereinabove described.

Thus, the rope reeve depicted in FIG. 6 acts to produce opposite and equal forces from relative movement of the sheaves. Offlead forces are eliminated between small sheave pairs 132 and 138, 134 and 140. Offlead forces in large sheave rows 118, 122 and 120, 124 are not eliminated, but are reeved in opposite directions to cancel one another. It will also be appreciated that the rope offlead angle between crown block sheaves 118, 120 and traveling block sheaves 122, 124 becomes negligible at the extended vertical lift distances of major interest, thus minimizing the need to horizontally cant sheaves 118, 120 or 122, 124 for such application.

Split traveling block 62 (FIG. 2) may be split as depicted in FIG. 6 to obtain a variety of block travel conditions. For conventional heavy loads over relatively short horizontal distances, the sheaves are split along horizontal split line 144. Thus, both crown block 50 and traveling block 62 (FIG. 2) provide tandem reeving between the sheaves for a maximum lift capability.

For a first increase in travel capability, with an attendant reduction in load capability, movable block section 76 (FIG. 5) may be separated from traveling block section 74 along a horizontal split line 146 and attached to crown block 50. Small canted sheaves 138, 140 permit movable block section 76 to be two-blocked directly beneath tandem crown block 50. The canted arrangement of small sheaves 138, 140 provides no offlead angle between the rows of small sheaves.

Further, there is no relative movement between small sheave rows 132 and 138, 134 and 140, which are reeved together such that there is no rope movement to produce rope wear and sheave wear in the two-blocked configuration, and there is zero offlead angle to eliminate forces tending to act adjacent the lips of the small sheaves. Now, the unit operates as a simple crown block and traveling block between reeved sheaves 118, 122 and 120, 124. The vertical travel capability and concurrent travel speed has now been increased by about 2:1 without re-reeving the main block.

A further increase in vertical travel distance and speed may be obtained by further splitting traveling blocks section 74 along first vertical split 150 and second vertical split 152 and attaching the outboard segments (see, e.g., section 72 in FIG. 2) to movable block section 76 (FIG. 5). The reeving arrangement depicted in FIG. 6 now enables these outboard sections to be in a stationary condition to further minimize rope and sheave wear. Further, inboard sheaves 70 (FIG. 2) are contained in a block section which preferrably has a width compatible with slimline operations for use in underwater guide sections 30 and/or extentions 26 (see FIG. 1), again without any need to re-reeve the main block.

In FIGS. 8–10, there are depicted preferred embodiments of the improved main block as discussed, particularly for FIGS. 5 and 6. FIG. 7 is a front view and partial cut-away of the sheave configuration of FIG. 5. The apparatus is symmetrical about main fall line 78. Tandem crown block 50 includes first large sheaves 118 with transition sheave 126. Traveling block section 74 includes second large sheaves 122 which reeve together with first large sheaves 118. Transition sheave 126 offleads to first small canted sheaves 138 in movable block section 76. Canted sheaves 138 are reeved with first small sheaves 132 to return the rope adjacent main fall line 178 for exit to external cross-over and equalizing sheaves.

Block section 76 may be connected with traveling block section 74 to form a tandem traveling block. Lower block ears 160 mate with reception plates 162 to align matching slots within which locking bar 164 is placed. Ears 160, reception plates 162 and locking bar 164 comprise lower connection assembly 156. As shown in FIG. 7, split block ears 166 may be provided for attaching movable block section 76 with crown block 50.

In FIG. 8, there is depicted movable block section 76 with sheaves 138 canted about main fall line 78. FIG. 9 depicts an arrangement for mounting canted sheaves 138 on a common axle. Sleeve spacers 172 and split sleeve 176 are stacked and bored at an angle effective to cant sheaves 138 within movable block section 76. Borehole 170 is then provided for accepting an axle common to a plurality of sheaves 138. Bearing 174 is conventionally provided on split sleeve 176 for permitting rotation of sheave 138.

FIG. 10 more particularly depicts structure connecting movable block section 76 with traveling block section 74. Reception plates 162 are aligned with ears 160 (FIG. 7) with locking bars 164 inserted in place. Locking tabs (not shown) may be provided to lock bars 164 within the connecting structure 156 (FIG. 7). The vertical forces acting upon locking bar 164 may tend to distort bar 164. Accordingly, lower connection assembly 156 (FIG. 7) is configured to enable locking bars 164 to be traversely removed from the locking slots rather than require axial movement for disengagement.

The traveling block section can be formed of three separable sections, including inboard section 200 containing inboard sheaves 70 (FIG. 2), and outboard sections 202 containing the outboard sheaves 72 on either side of section 200. Sections 200 and 202 are separated along lines 169, corresponding to vertical splits 150 and 152 (FIG. 6) so that each section 200 and 202 can move independently of the other. Normally sections 200 and 202 will be secured together by any suitable means, such as removable pins 204, to form a unitary travelling block section 74. However, upon removal of pins 204, the sections 202 can be secured to movable block section 76 by lower connection assembly 156, and section 200 can be operated independently as a slim line block.

It will be appreciated that a similar locking arrangement may be provided between movable block assembly 76 and crown block 50 (FIG. 7). Specifically, a connection assembly 157 is provided which includes split block ears 166 on block section 76, reception plate 167 on crown block 50 and locking bars 168 to lock block section 76 to crown block 50. It will further be appreciated that the load must be carried in the two-blocked configuration is substantially less than the load which is carried by interconnecting movable block section 76 with traveling section 74 and the connecting arrangement may be scaled in a corresponding manner.

It is therefore apparent that the present invention is one well adapted to obtain all of the operative aspects hereinabove set forth together with other aspects which will become obvious and inherent from a description of the apparatus itself. It will be understood that certain combinations and subcombinations are of utility and may be obtained without reference to other features and subcombinations. It is contemplated by and is within the scope of the present invention.

What is claimed is:

1. A crane block defining a central main fall symmetry line for vertical rope travel during movement of a rope hoist comprising:

a crown block for mounting to a crane boom and having a first row of relatively large diameter sheaves in tandem with a second row of relatively small diameter sheaves;

a movable block having a third row of relatively small diameter sheaves reeved with said second row;

a traveling block having a fourth row of relatively large diameter sheaves reeved with said first row;

one of said second or third rows having said sheaves canted with respect to said main fall symmetry line for vertical travel of said rope between said second and third rows of said sheaves;

connecting means for removably securing said movable block with said traveling block for lifting relatively heavy loads over relatively small vertical travel;

connecting means for removably securing said movable block in a two-blocked configuration beneath said crown block for lifting relatively lighter loads over relatively extended vertical travel;

detachable support means on said traveling block for defining a set of outboard sheaves on either side of said main fall symmetry line and a set of inboard sheaves across said main fall symmetry line;

means for detaching said outboard sheaves from said inboard sheaves for further extending vertical travel of said traveling block and reducing the size of said traveling block when said movable block is attached to said crown block; and means for removably attaching said detachable support means for said outboard sheaves to said movable block to reduce rope and sheave wear and to reduce down-haul weight when extended vertical travel is required for relatively light loads.

2. A method for configuring a rope on a main block having first and second portions symmetrical about a main fall line for minimizing forces tending to rotate said block during extended travel operation, comprising the steps of:

reeving said first portion of said block defined by said main fall line including reeving together a row of relatively large diameter sheaves in a crown block and in a traveling block, said reeve moving in a first direction relative to said main fall line;

continuing said reeving in a second direction relatively opposite said first direction and between a row of relatively small diameter sheaves in said crown block and a row of relatively small diameter sheaves in a movable block where said movable block sheaves are canted to obtain substantially vertical reeving with no offlead angle;

passing said rope from said relatively small diameter sheave to an equalizer sheave having an axis of rotation in the plane of said main fall line; and reeving said second portion of said block to mirror said reeving of said first portion.

3. A method according to claim 2, further including the step of:

removably attaching said movable block with said traveling block for lifting relatively large loads over limited vertical travel.

4. A method according to claim 2, further including the step of:

removably attaching said movable block in two-blocked relationship beneath said crown block for lifting a relatively small load over extended vertical travel.

5. The method according to claim 4, further including the steps of:

detaching outboard sheaves from said traveling block to form a traveling block of a selected reduced width effective for slimline operations;

removably fixing said detached sheaves beneath said movable block; and said first reeving direction being effective to render said small diameter sheaves and said detached sheaves stationary when said reduced length traveling block is moved vertically.

* * * * *